US011029072B2

(12) United States Patent
Hirai et al.

(10) Patent No.: US 11,029,072 B2
(45) Date of Patent: Jun. 8, 2021

(54) COOLING DEVICE

(71) Applicant: Samsung Electronics Co., Ltd., Suwon-si (KR)

(72) Inventors: Shinji Hirai, Yokohama (JP); Makoto Kobayashi, Yokohama (JP); Masanaga Tanaka, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 60 days.

(21) Appl. No.: 15/538,512

(22) PCT Filed: Jan. 5, 2016

(86) PCT No.: PCT/KR2016/000068
§ 371 (c)(1),
(2) Date: Jun. 21, 2017

(87) PCT Pub. No.: WO2016/111531
PCT Pub. Date: Jul. 14, 2016

(65) Prior Publication Data

US 2017/0350630 A1 Dec. 7, 2017

(30) Foreign Application Priority Data

Jan. 5, 2015 (JP) ..... JP2015-000343
Jan. 14, 2015 (JP) ..... JP2015-004638
(Continued)

(51) Int. Cl.
*F25D 11/02* (2006.01)
*F25B 39/04* (2006.01)
(Continued)

(52) U.S. Cl.
CPC ..... *F25D 11/022* (2013.01); *F25B 1/005* (2013.01); *F25B 5/04* (2013.01); *F25B 6/04* (2013.01);
(Continued)

(58) Field of Classification Search
CPC ..... F25B 41/003; F25B 41/04; F25B 1/005; F25B 5/04; F25B 6/05; F25B 39/04;
(Continued)

(56) References Cited

U.S. PATENT DOCUMENTS 4,850,200 A * 7/1989 Sugiyama ..... F25D 21/002 62/156
5,406,805 A 4/1995 Radermacher et al.
(Continued)

FOREIGN PATENT DOCUMENTS

CN 86203403 1/1987
CN 1134747 10/1996
(Continued)

OTHER PUBLICATIONS

JP 2006317079: Partial English Machine Translation: Accessed Dec. 2019.*
(Continued)

*Primary Examiner* — Tavia Sullens
(74) *Attorney, Agent, or Firm* — Staas & Halsey LLP

(57) ABSTRACT

A cooling device including a freezing cycle including a compressor, a condenser, a pressure reducing means, and an evaporator is provided. In the cooling device, the condenser includes a first condenser and a second condenser independent from each other, the second condenser being positioned at a downstream side of the first condenser in a refrigerant channel, and the first condenser and the second condenser are connected to each other through a dew condensation preventing pipe.

2 Claims, 16 Drawing Sheets

(30) Foreign Application Priority Data

Dec. 18, 2015 (JP) ..... JP2015-247978
Jan. 5, 2016 (KR) ..... 10-2016-0000911

(51) Int. Cl.

| | |
|---|---|
| ***F25B 5/04*** | (2006.01) |
| ***F25B 49/02*** | (2006.01) |
| ***F25B 6/04*** | (2006.01) |
| ***F25B 41/20*** | (2021.01) |
| ***F25B 1/00*** | (2006.01) |

(52) U.S. Cl.
CPC ..... *F25B 39/04* (2013.01); *F25B 41/20* (2021.01); *F25B 49/02* (2013.01); *F25B 2339/041* (2013.01); *F25B 2400/0403* (2013.01); *F25B 2400/0409* (2013.01); *F25B 2600/2501* (2013.01); *F25C 2700/12* (2013.01)

(58) Field of Classification Search
CPC ..... F25B 49/02; F25B 2339/041; F25B 2400/0403; F25B 2400/0409; F25B 2400/0411; F25B 2600/2501; F25D 21/04; F25D 11/022; F25C 2700/12
See application file for complete search history.

(56) References Cited

U.S. PATENT DOCUMENTS

| | | | |
|---|---|---|---|
| 6,327,867 | B1 | 12/2001 | Hyodo et al. |
| 8,769,975 | B2 | 7/2014 | Lee et al. |
| 2008/0178621 | A1 | 7/2008 | Kang |
| 2008/0184713 | A1 | 8/2008 | Huff et al. |

FOREIGN PATENT DOCUMENTS

| | | | |
|---|---|---|---|
| CN | 1936462 | | 3/2007 |
| CN | 102410693 | A | 4/2012 |
| CN | 102401534 | B | 11/2013 |
| DE | 102011006856 | | 10/2012 |
| DE | 102011086553 | | 5/2013 |
| EP | 1344997 | | 9/2003 |
| EP | 1 835 242 | A2 | 9/2007 |
| EP | 2225507 | | 9/2010 |
| JP | 9-261879 | | 10/1997 |
| JP | 2000-18789 | | 1/2000 |
| JP | 2004-144365 | | 5/2004 |
| JP | 2004-317069 | | 11/2004 |
| JP | 2005-249254 | | 9/2005 |
| JP | 2006-317079 | | 11/2006 |
| JP | 2009-174767 | | 8/2009 |
| JP | 2009-264629 | | 11/2009 |
| JP | 2013-61083 | | 4/2013 |
| JP | 5260535 | | 5/2013 |
| KR | 10-0140961 | | 3/1996 |
| KR | 10-0751109 | | 8/2007 |
| KR | 10-2013-0083871 | | 7/2013 |
| KR | 10-2014-0030025 | | 3/2014 |
| WO | 2007/072989 | A2 | 6/2007 |
| WO | 2008/056913 | | 5/2008 |

OTHER PUBLICATIONS

International Search Report dated Apr. 7, 2016 in corresponding International Patent Application No. PCT/KR2016/000068.
Written Opinion of the International Searching Authority dated Apr. 7, 2016 in corresponding International Patent Application No. PCT/KR2016/000068.
Extended European Search Report dated May 17, 2018 in European Patent Application No. 16734152.7.
Chinese Office Action dated May 8, 2019 in Chinese Patent Application No. 201680005015.4.
Partial Supplementary European Search Report dated Jan. 22, 2018, in corresponding European Patent Application No. 16735152.7, 12 pgs.
Chinese Office Action dated Mar. 16, 2020 in Chinese Patent Application No. 201680005015.4.
European Communication dated Jun. 18, 2020 in European Patent Application No. 16735152.7.
Chinese Office Action dated Jul. 3, 2020 in Chinese Patent Application No. 201680005015.4.

* cited by examiner

COOLING DEVICE

CROSS-REFERENCE TO RELATED APPLICATIONS

This application is a U.S. National Stage Application, which claims the benefit under 35 U.S.C. § 371 of PCT International Patent Application No. PCT/KR2016/000068, filed Jan. 5, 2016 which claims the foreign priority benefit under 35 U.S.C. § 119 of Korean Patent Application No. 10-2016-0000911, filed Jan. 5, 2016, and Japanese Patent Application Nos. 2015-247978, 2015-004638, and 2015-000343, filed on Dec. 18, 2015, Jan. 14, 2015, and Jan. 5, 2015, respectively, the contents of which are incorporated herein by reference.

TECHNICAL FIELD

The present disclosure relates to a cooling device having a freezing cycle.

BACKGROUND ART

A cooling device (for example, a refrigerator) according to the related art includes a compressor, a condenser, a dew condensation preventing pipe, a pressure reducing means, and an evaporator, as illustrated in FIG. 1A, and has a freezing cycle in which these components are connected to each other in such a sequence through pipes (for example, Patent Document 1 (Japanese Patent Laid-Open Publication No. 1986-191862)).

However, since such a freezing cycle has a configuration in which a refrigerant condensed by heat exchange in the condenser and having a high liquid ratio passes through the dew condensation preventing pipe, as illustrated in FIG. 1C, a ratio of liquid refrigerant in the dew condensation preventing pipe is increased, and an amount of refrigerant is increased. That is, a heat exchange amount per unit volume (W/liter) of the condenser is greater than that (W/liter) of the dew condensation preventing pipe. Therefore, when the refrigerant liquefied in the condenser and having the high liquid ratio is introduced into the dew condensation preventing pipe, the liquid ratio in the dew condensation preventing pipe is high, and an amount of refrigerant in the dew condensation preventing pipe is increased.

Meanwhile, as illustrated in FIG. 2A, it may be considered to exchange sequences of the condenser and the dew condensation preventing pipe with each other to allow a gas refrigerant to be introduced into the dew condensation preventing pipe and reduce a liquid ratio in the dew condensation preventing pipe, thereby reducing an amount of refrigerant.

However, since a temperature of the gas refrigerant introduced into the dew condensation preventing pipe is higher than a condensing temperature, an amount of heat invaded into the refrigerant is increased.

In addition, Patent Document 2 (Japanese Patent Laid-Open Publication No. 2007-248005) has disclosed a configuration in which a dew condensation preventing pipe is disposed between an upstream radiator and a downstream radiator and a carbon dioxide refrigerant in a supercritical state is released to the upstream radiator, the dew condensation preventing pipe, and the downstream radiator.

However, heat radiation of the carbon dioxide refrigerant in the supercritical state is a sensible heat change (see FIG. 3A), and a temperature of the carbon dioxide refrigerant in the supercritical state is changed during a period in which the carbon dioxide refrigerant in the supercritical state flows to the dew condensation preventing pipe. Therefore, a temperature distribution is generated in the dew condensation preventing pipe, such that dew condensation preventing performances of the dew condensation preventing pipe are different from each other depending on a place.

DISCLOSURE

Technical Problem

An object the present disclosure is to reduce an amount of refrigerant of a freezing cycle.

Technical Solution

According to an aspect of the present disclosure, a cooling device includes: a freezing cycle including a compressor, a condenser, a pressure reducing means, and a cooling evaporator, wherein the condenser includes a first condenser and a second condenser independent from each other, the second condenser being positioned at a downstream side of the first condenser in a refrigerant channel, and the first condenser and the second condenser are connected to each other through a dew condensation preventing pipe.

The cooling device may further include a bypass branched between the second condenser and the pressure reducing means and joined between the pressure reducing means and the cooling evaporator; an ice-making evaporator disposed in the third bypass; and an ice-making pressure reducing means disposed at an upstream side of the ice-making evaporator in the third bypass.

According to another aspect of the present disclosure, a cooling device includes: a freezing cycle including a compressor, a condenser, a pressure reducing means, and an evaporator, wherein the condenser includes two channels having, respectively, inlets and outlets and isolated from each other, and the outlet of any one of the two channels is connected to one end of a dew condensation preventing pipe, and the input of the other of the two channels is connected to the other end of the dew condensation preventing pipe.

Advantageous Effects

According to the present disclosure configured as described above, the condenser is divided into the first condenser and the second condenser, the first condenser, the dew condensation preventing pipe, the second condenser are sequentially connected to each other, and the dew condensation preventing pipe is configured so that a refrigerant flows in a gas-liquid two-phase state thereto. Therefore, heat invaded from the dew condensation preventing pipe to a cooling chamber may be equal to that of the related art, and an amount of refrigerant of the freezing cycle may be reduced.

BEST MODE

Figure 1A:
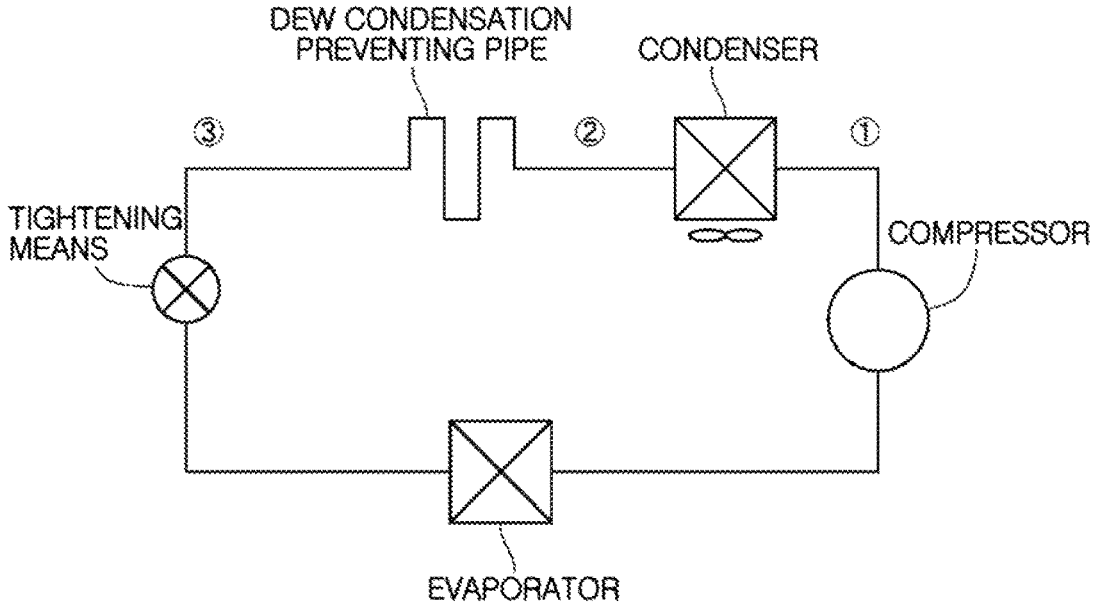
FIGS. 1A to 1C are views illustrating, a configuration of a freezing cycle of a cooling device according to the related art, a Mollier diagram of the corresponding freezing cycle, and a gas-liquid two-phase state of a refrigerant in a dew condensation preventing pipe.
Figure 1B:
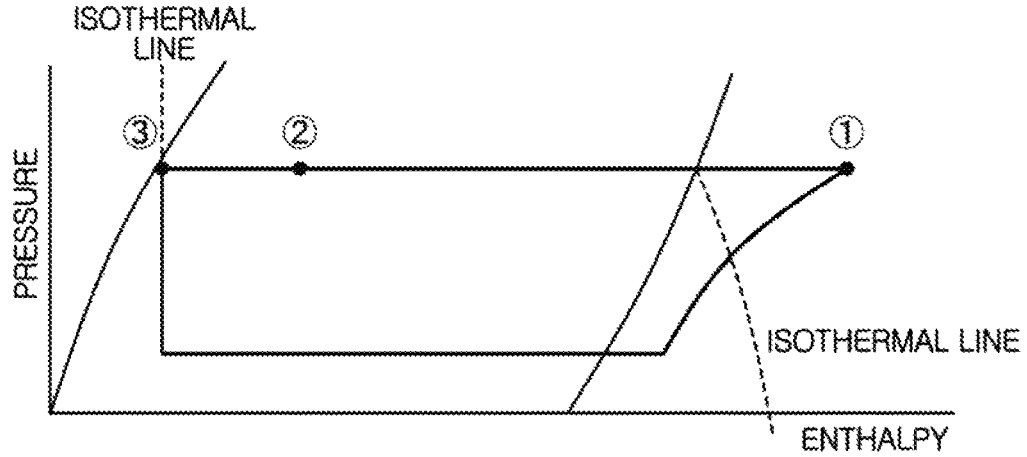
Figure 1C:
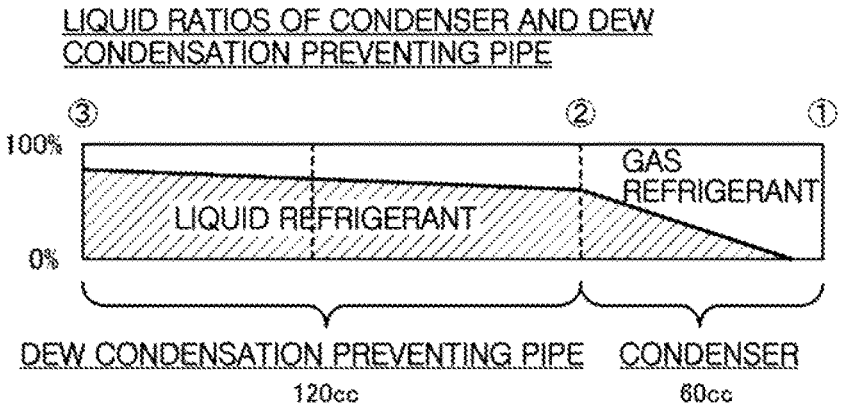
Figure 2A:
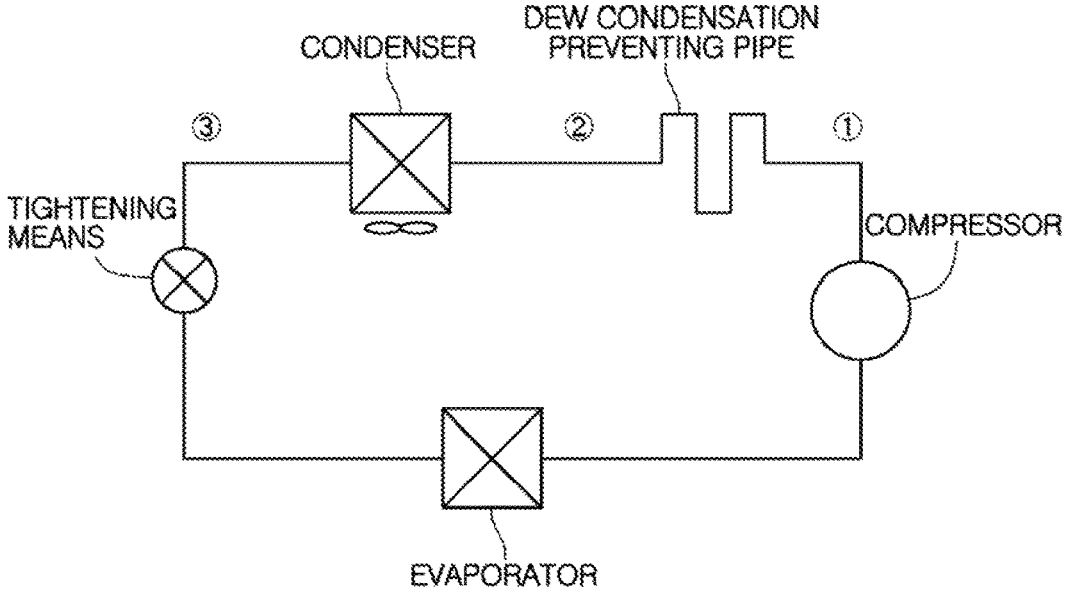
FIGS. 2A to 2C are views illustrating, a configuration of a modified disposition of a freezing cycle of a cooling device according to the related art, a Mollier diagram of the corresponding freezing cycle, and a gas-liquid two-phase state of a refrigerant in a dew condensation preventing pipe.
Figure 2B:
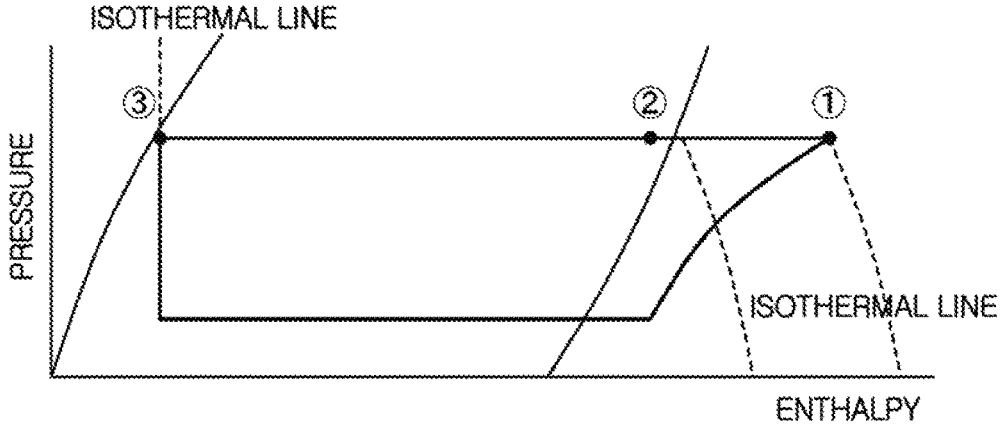
Figure 2C:
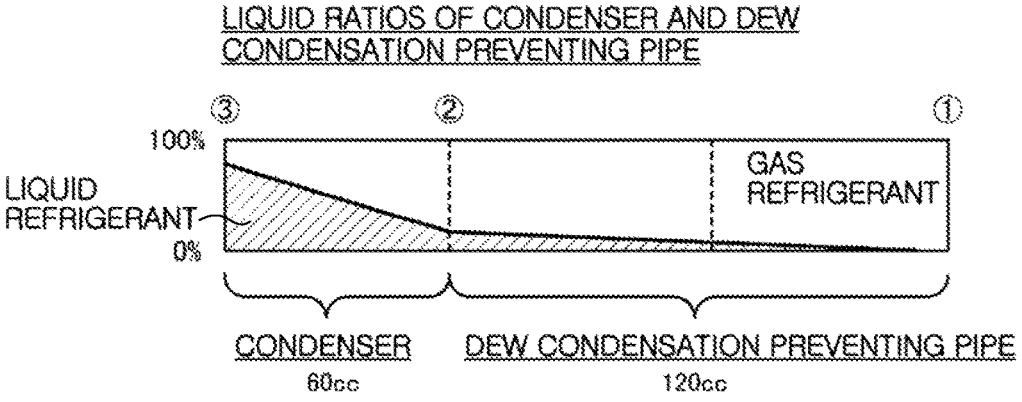
Figure 3A:
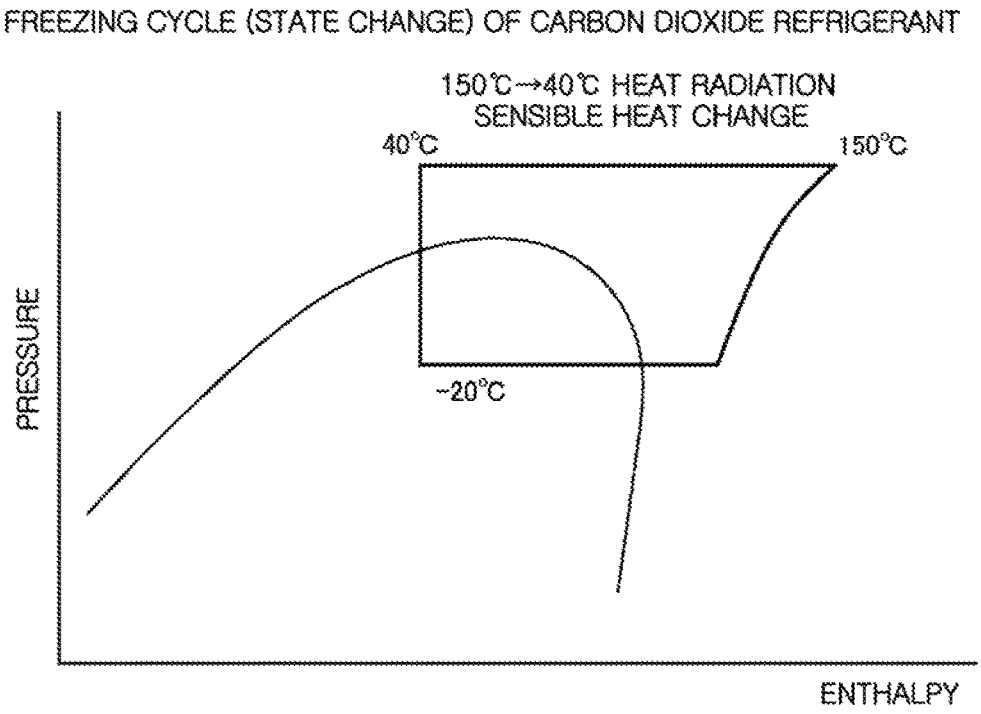
FIGS. 3A and 3B are views illustrating Mollier diagrams of freezing cycles (state changes) of a carbon dioxide refrigerant and an R600a refrigerant.
Figure 3B:
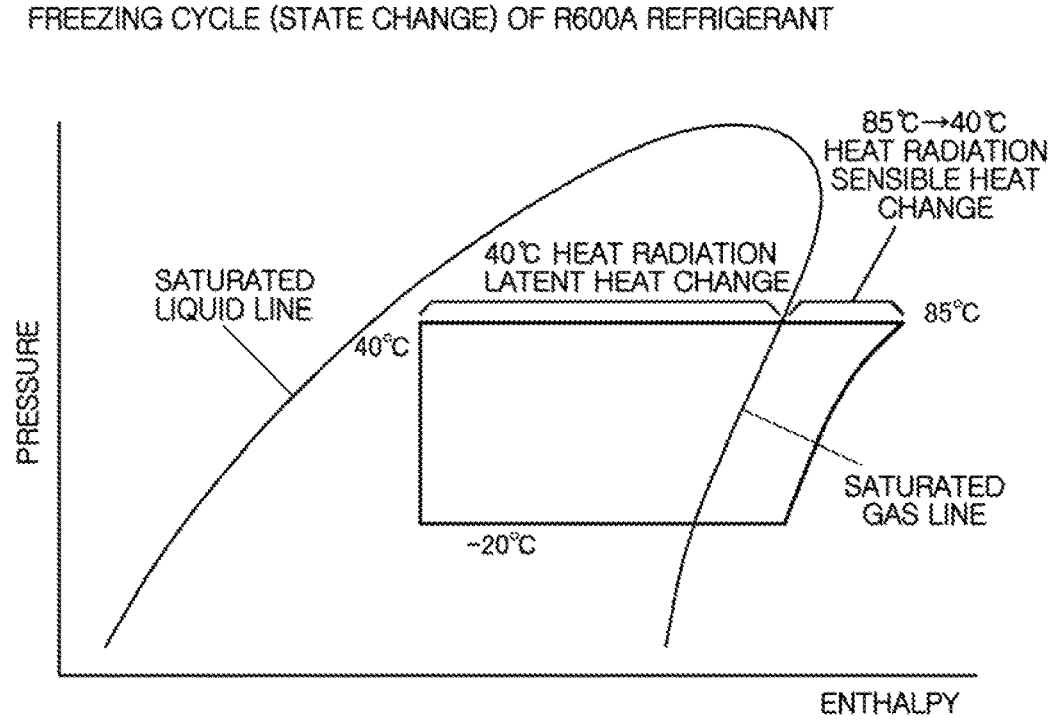

Hereinafter, various exemplary embodiments of the present disclosure will be described with reference to the accompanying drawings. However, it is to be understood that technologies mentioned in the present disclosure are not limited to specific exemplary embodiments, but include various modifications, equivalents, and/or substitutions according to exemplary embodiments of the present disclosure. Throughout the accompanying drawings, similar components will be denoted by similar reference numerals.

In addition, expressions "first", "second", or the like, used in the present disclosure may indicate various components regardless of a sequence and/or importance of the components, will be used only to distinguish one component from the other components, and do not limit the corresponding components. For example, a 'first portion' and a 'second portion' may indicate different portions regardless of a sequence or importance. For example, a first component may be named a second component and the second component may also be similarly named the first component, without departing from the scope of the present disclosure.

Terms used in the present disclosure may be used only to describe specific exemplary embodiments rather than restricting the scope of other exemplary embodiments. Singular forms may include plural forms unless the context clearly indicates otherwise. Terms used in the present specification including technical and scientific terms have the same meanings as those that are generally understood by those skilled in the art to which the present disclosure pertains. Terms defined by a general dictionary among terms used in the present disclosure may be interpreted as meaning that are the same as or similar to meanings within a context of the related art, and are not interpreted as ideal or excessively formal means unless clearly defined in the present disclosure. In some cases, terms may not be interpreted to exclude exemplary embodiments of the present disclosure even though they are defined in the present disclosure.

Hereinafter, a configuration of a cooling device according to an exemplary embodiment in the present disclosure will be described.

Figure 4A:
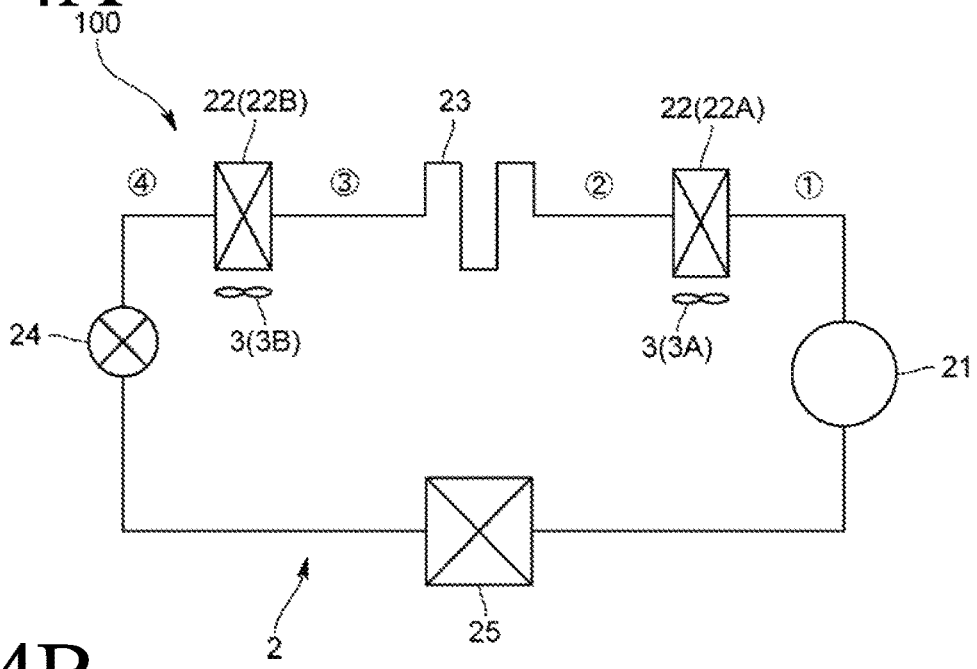
FIGS. 4A to 4C are views illustrating, a configuration of a freezing cycle of a cooling device according to an exemplary embodiment in the present disclosure, a Mollier diagram of the corresponding freezing cycle, and a gas-liquid two-phase state of a refrigerant in a dew condensation preventing pipe.
Figure 4B:
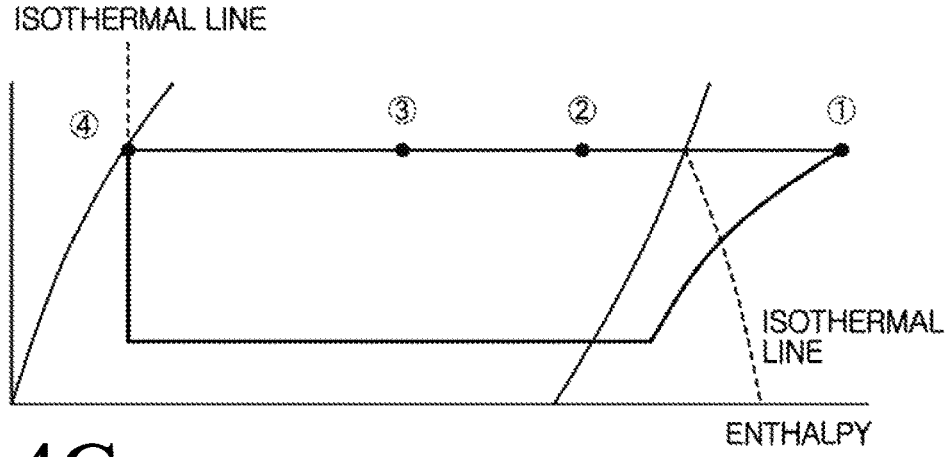
Figure 4C:
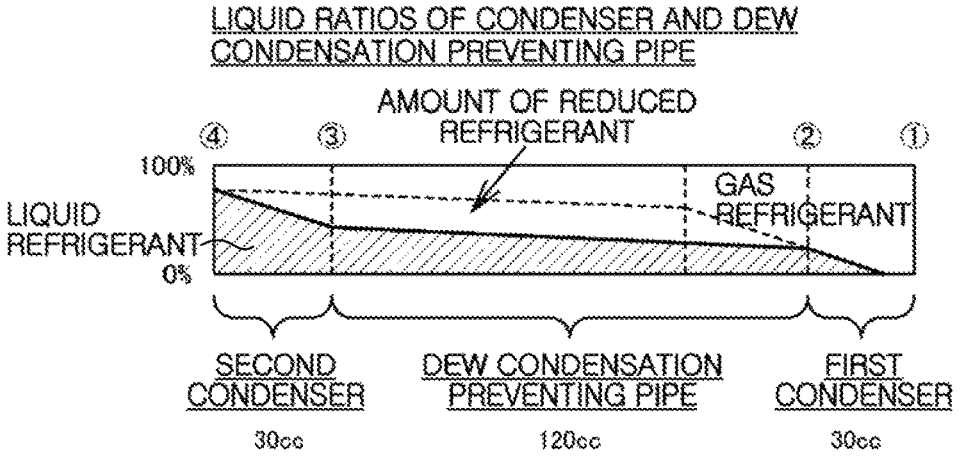

FIGS. 4A to 4C are views illustrating, a configuration of a freezing cycle of a cooling device according to an exemplary embodiment in the present disclosure, a Mollier diagram of the corresponding freezing cycle, and a gas-liquid two-phase state of a refrigerant in a dew condensation preventing pipe.

The cooling device 100 according to an exemplary embodiment of the present disclosure is a device accommodating and cooling, for example, food therein, such as a refrigerator, a freezer, or a refrigerator-freezer, and has one cooling chamber or a plurality of cooling chambers. In addition, the cooling chamber includes a cold chamber, a freezing chamber, a vegetable chamber, a bottle chamber, and the like.

In detail, the cooling device 100 includes a freezing cycle 2 in which a compressor 21, a condenser 22, a dew condensation preventing pipe 23, a main pressure reducing means (a capillary tube or an electronic expansion valve) 24, and a cooling evaporator 25 are connected to each other through refrigerant pipes, a blowing fan 3 cooling the condenser 22, and a control device (not illustrated) controlling the freezing cycle 2, the blowing fan 3, and the like, to perform a cooling control of an entire cooling device, as illustrated in FIG. 4A. In addition, the dew condensation preventing pipe 23 prevents dew condensation of an important portion of a body of the cooling device 100. For example, the dew condensation preventing pipe 23 is disposed in a wall forming each opening of a front surface of the body to prevent dew condensation of the corresponding opening. The control device is configured by, for example, a computer including a central processing unit (CPU), a memory, an analog to digital (A/D) or digital to analog (D/A) converter, input and output means, and the like, allows a program for a refrigerator stored in the memory to be executed, and allows various apparatuses to cooperate with each other to allow their functions to be realized.

In addition, the condenser 22 is divided into a first condenser 22A and a second condenser 22B. Here, the condenser 22 is divided so that a cooling temperature of an outlet of the first condenser 22A is equal to or less than a condensation temperature of the refrigerant and a difference between the cooling temperature of an outlet of the first condenser 22A and a refrigerant temperature of an outlet of the dew condensation preventing pipe 23 is within 2□. Therefore, an amount of refrigerant may be reduced, and an amount of gas refrigerant introduced into the dew condensation preventing pipe 23 may be controlled. In addition, the first condenser 22A and the second condenser 22B are provided with blowing fans 3A and 3B, respectively. In addition, the first condenser 22A, the dew condensation preventing pipe 23, the second condenser 22B are sequentially connected to each other, and the dew condensation preventing pipe 23 is configured so that a refrigerant flows in a gas-liquid two-phase state thereto. This refrigerant is a hydrocarbon based refrigerant, and R600a, which is a natural refrigerant, may be used in the present exemplary embodiment. In addition, R134a may also be used as the refrigerant. In addition, both of a volume of a refrigerant pipe configuring the first condenser 22A and a volume of a refrigerant pipe configuring the second condenser 22B may be 30 cc, and a content volume of a refrigerant pipe configuring the dew condensation preventing pipe 23 may be 120 cc. In addition, the volume of the refrigerant pipe configuring the first condenser 22A and the volume of the refrigerant pipe configuring the second condenser 22B do not need to be the same as each other, and may also be configured to be different from each other.

Here, the first condenser 22A makes the gas refrigerant output from the compressor 21 a heat exchange amount in which a liquid ratio is low, while cooling a refrigerant temperature of the gas refrigerant to a condensation temperature. Therefore, a liquid ratio in a gas-liquid two-phase refrigerant introduced into the dew condensation preventing pipe 23 becomes low (see FIG. 4C).

Since a heat exchange amount per unit volume (W/liter) of the dew condensation preventing pipe 23 is small, an increase ratio in the liquid ratio in the dew condensation preventing pipe 23 is low, such that the liquid ratio in the dew condensation preventing pipe 23 is maintained in a state in which it is lower than a gas ratio in the dew condensation preventing pipe 23. In addition, a gas-liquid two-phase refrigerant introduced into the second condenser 22B is in a state in which a liquid ratio is low (see FIG. 4C).

Since a heat exchange amount per unit volume (W/liter) of the second condenser 22B is large, a liquid ratio of the gas-liquid two-phase refrigerant becomes high at a refrigerant outlet of the second condenser 22B (see FIG. 4C).

According to the cooling device 100 configured as described above, the condenser 22 is divided into the first condenser 22A and the second condenser 22B, and the first condenser 22A, the dew condensation preventing pipe 23, and the second condenser 22B are sequentially connected to each other. At the same time, since the dew condensation preventing pipe 23 is configured so that the refrigerant flows in the gas-liquid two-phase state thereto, a ratio of a liquid refrigerant in the gas-liquid two-phase refrigerant flowing to the dew condensation preventing pipe 23 may be reduced. Therefore, a liquid gathered in the dew condensation preventing pipe 23 may be reduced, and an amount of refrigerant of the freezing cycle 2 may be reduced. In addition, since the gas-liquid two-phase refrigerant flowing to the dew condensation preventing pipe is cooled up to the condensation temperature by the first condenser 22A, heat invaded from the dew condensation preventing pipe 23 to the cooling chamber may be equal to that of the related art. In addition, the gas-liquid two-phase refrigerant flows to the dew condensation preventing pipe 23, thereby making it possible to uniformize a temperature over the entire dew condensation preventing pipe 23.

Further, since an amount of R600a having combustibility may be reduced, safety may be improved, and a cost may be reduced. Further, R600a is a natural refrigerant, and may reduce an influence on an environment.

Further, the present disclosure is not limited to an exemplary embodiment described above, but may also be configured as in modified examples of an exemplary embodiment of the present disclosure to be described below.

Figure 5:
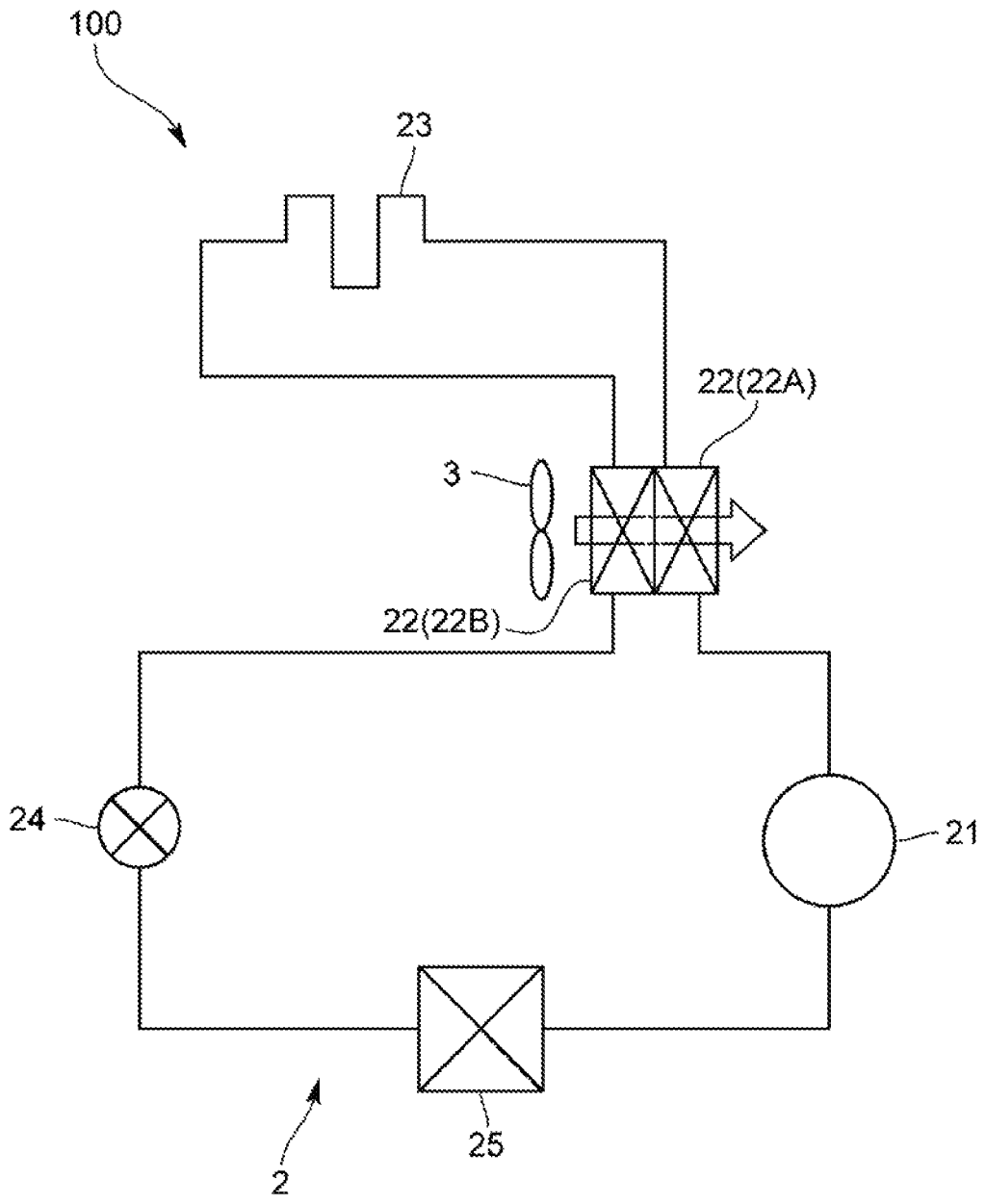
FIGS. 5 to 7 are views illustrating, respectively, configurations of freezing cycles of cooling devices according to modified examples of an exemplary embodiment of the present disclosure.
Figure 6:
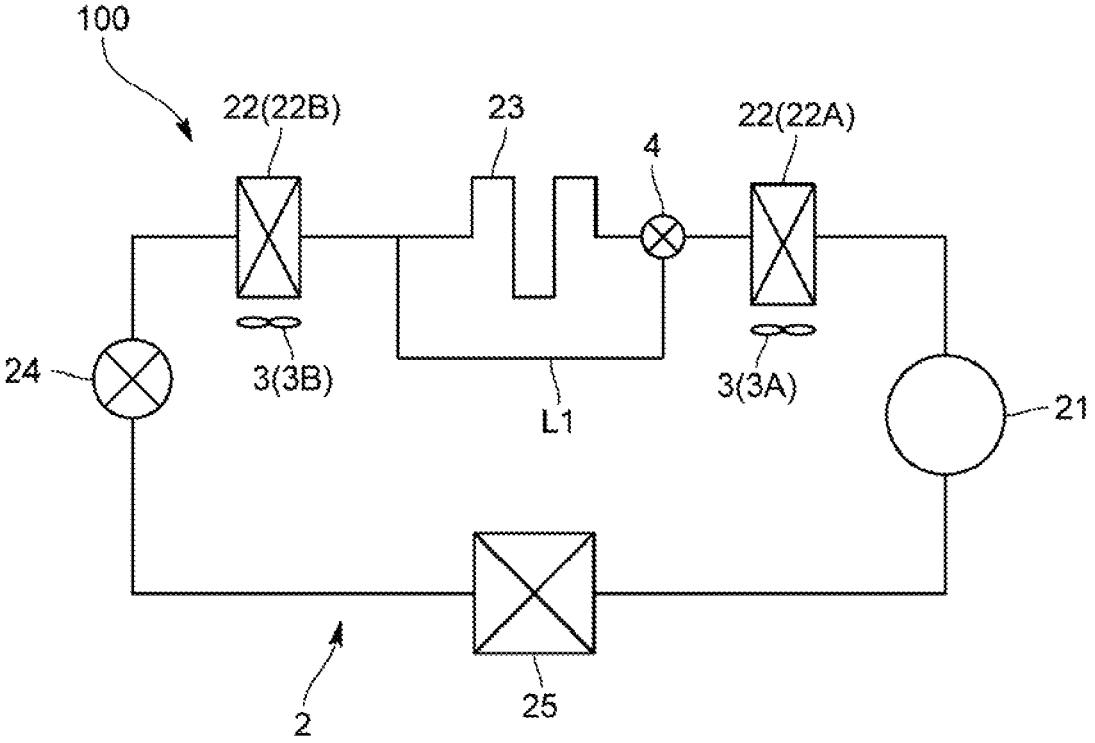
Figure 7:
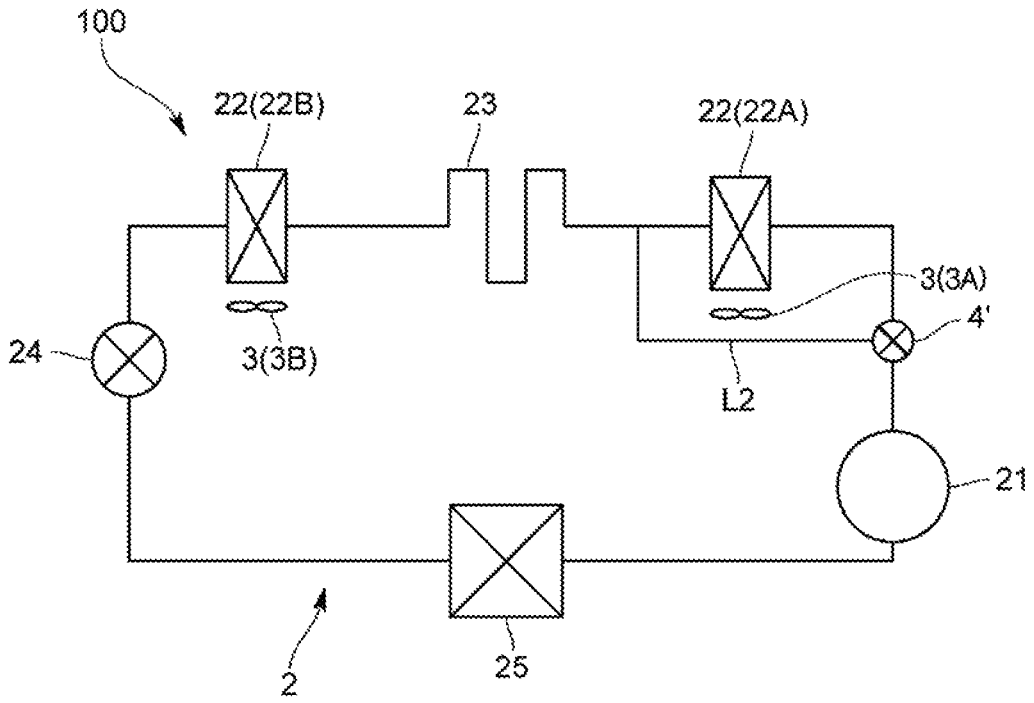

FIGS. 5 to 7 are views illustrating, respectively, configurations of freezing cycles of cooling devices according to modified examples of an exemplary embodiment of the present disclosure.

As illustrated in FIG. 5, the first condenser 22A and the second condenser 22B may also be integrated with each other. That is, the first condenser 22A and a second condenser 22B may be integrated with each other by being in contact with each other or being disposed to be adjacent to each other and face each other or may be integrated with each other by using a blowing fan of the first condenser 22A or a blowing fan of the second condenser 22B for heat radiation in common. Therefore, configurations of the freezing cycle 2 and the cooling device 100 may be simplified.

In addition, the first condenser 22A and the second condenser 22B may be configured to be cooled by a common blowing fan 3. Here, as illustrated in FIG. 5, the first condenser 22A may be positioned at an upstream side of the second condenser 22B in a refrigerant channel of the freezing cycle. Alternatively, it is preferable that the first condenser 22A is disposed at a downstream side of the second condenser 22B in a flow of air depending on the blowing fan 3 (see FIG. 5). Therefore, air warmed while passing through the second condenser is in contact with the first condenser to easily make the refrigerant a state in which a liquid ratio is low while cooling the refrigerant up to the condensation temperature in the first condenser.

In addition, as illustrated in FIG. 6, a first bypass L1 branched between the first condenser 22A and the dew condensation preventing pipe 23 and joined between the dew condensation preventing pipe 23 and the second condenser 22B may be provided, and a first switching mechanism 4 switching a channel may be disposed at a branch point of the first bypass L1. The first switching mechanism 4 is a switching valve formed of a three-way valve. Opening or closing of the switching valve is controlled by a control device (not illustrated).

In addition, the control device controls the first switching valve 4 to allow the refrigerant to flow the first bypass L1 and allow the refrigerant not to flow the dew condensation preventing pipe 23, in the case in which a temperature difference between an internal temperature in a refrigerator and a surrounding external air temperature is small, for example, in the case of a full-down operation from the supply of power until a temperature arrives at an initial set temperature, or in the case in which a surrounding humidity is low.

Due to this configuration, in the case in which the refrigerant does not need to flow to the dew condensation preventing pipe 23, the refrigerant does not flow to dew condensation preventing pipe 23, and invasion of heat into the refrigerator may thus be reduced.

In the case in which the external air temperature is low or an evaporation temperature is low, the refrigerant is rapidly condensed, such that the liquid refrigerant may be gathered in the first condenser 22A to cause a cooling fault. In addition, this fault may occur also in the case of a freezing cycle having a plurality of evaporators or in the case in which a cooling load is small. Therefore, as illustrated in FIG. 7, a second bypass L2 branched between the compressor 21 and the first condenser 22A and joined between the first condenser 22A and the dew condensation preventing pipe 23 may be provided, and a second switching mechanism 4' switching a channel may be disposed at a branch point of the second bypass L2. The second switching mechanism 4' is a switching valve formed of a three-way valve. Opening or closing of the switching valve is controlled by a control device (not illustrated). In addition, the control device controls the second switching valve 4' on the basis of, for example, a detection temperature of an external air temperature sensor, or the like, to switch the channel through which the refrigerant is introduced into the first condenser 22A.

Due to this configuration, an amount of liquid refrigerant staying in the first condenser 22A may be reduced.

In addition, it may be considered that the first condenser is configured to change condensation capability depending on the surrounding temperature. In detail, the cooling device 100 may include an outlet temperature sensor (not illustrated) disposed at an outlet of the first condenser 22A and a controller (not illustrated) controlling the blowing fan of the first condenser 22A. It may be considered that the controller acquires a detection temperature of the outlet temperature sensor and controls a revolutions per minute (RPM) of the blowing fan so that the detection temperature becomes a predetermined target value, thereby changing the condensation capability of the first condenser. In addition, it may be considered that the number of heat pipes through the refrigerant flows in the first condenser is configured to be controlled by, for example, an opening or closing valve.

Next, a cooling device according to another exemplary embodiment of the present disclosure will be described with reference to the drawings.

Figure 8:
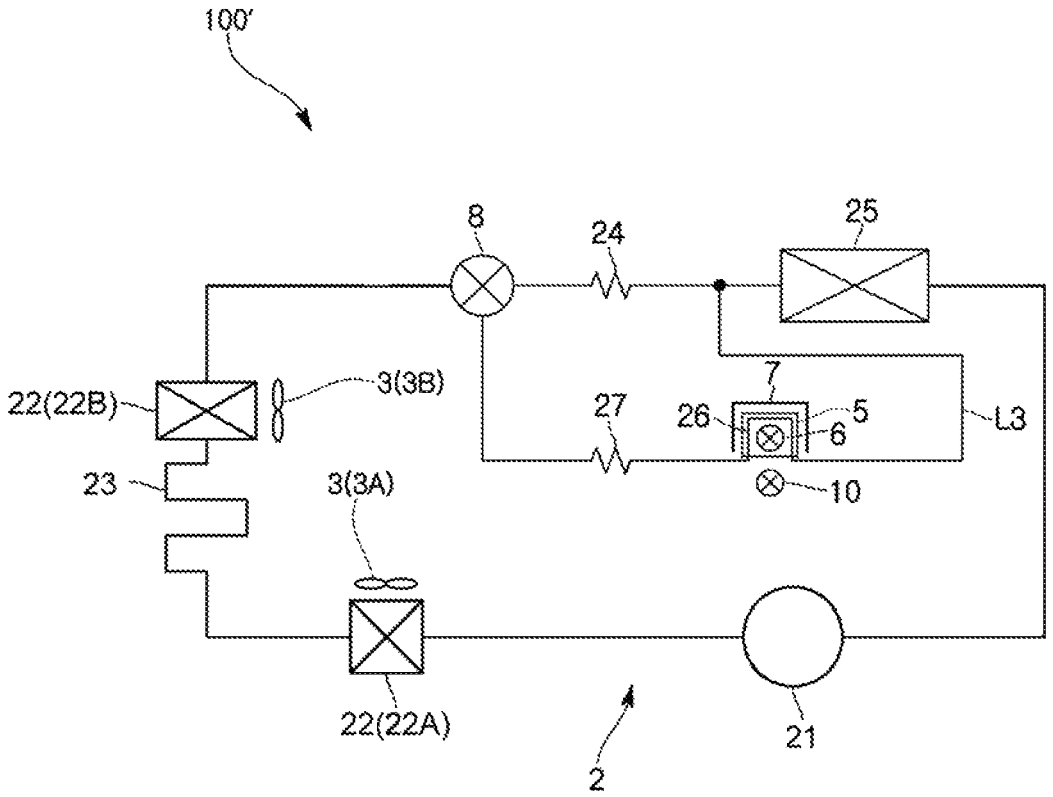
FIG. 8 is a view illustrating a configuration of a freezing cycle of a cooling device according to another exemplary embodiment of the present disclosure.

FIG. 8 is a view illustrating a configuration of a freezing cycle of a cooling device according to another exemplary embodiment of the present disclosure.

The cooling device 100' according to another exemplary embodiment of the present disclosure may include a freezing cycle 2 in which a compressor 21, a condenser 22, a dew condensation preventing pipe 23, a main pressure reducing means 24, and a cooling evaporator 25 are connected to each other through refrigerant pipes, a blowing fan 3 cooling the condenser 22, and a control device (not illustrated) controlling the freezing cycle 2, the blowing fan 3, and the like, to perform a cooling control of an entire cooling device, as illustrated in FIG. 8. In addition, the dew condensation preventing pipe 23 prevents dew condensation of an important portion of a body of the cooling device 100. For example, the dew condensation preventing pipe 23 may be disposed in a wall forming each opening of a front surface of the body to prevent dew condensation of the corresponding opening. In addition, a configuration of the condenser 22 may be the same as that of the condenser 22 according to an exemplary embodiment of the present disclosure described above.

In addition, the cooling device according to the present exemplary embodiment includes an ice-making evaporator 26 making ice by cooling an ice-making tray 5 provided in an ice-making chamber, an ice-making pressure reducing means (a capillary tube or an electronic expansion valve) 27 provided at an upstream side of the ice-making evaporator 26, an ice-making tray temperature sensor 6 provided in the ice-making tray 5, and a deicing heater 7 for deicing by heating the ice-making tray 5. In addition, reference numeral 10 indicates a cold insulation storage temperature sensor.

The ice-making evaporator 26 and the ice-making pressure reducing means 27 are provided in a third bypass L3 branched between the second condenser 22B and the main pressure reducing means 24 and joined between the main pressure reducing means 24 and the cooling evaporator 25. In addition, a third switching mechanism 8 switching a channel may be disposed at a branch point of the second bypass L3. The third switching mechanism 8 is a switching valve formed of a three-way valve. The switching valve 8 has a port adjacent to the condenser, a port adjacent to the bypass, and a port adjacent to the main pressure reducing means, and opening or closing of the switching valve 8 is controlled by a control device (not illustrated).

Figure 9:
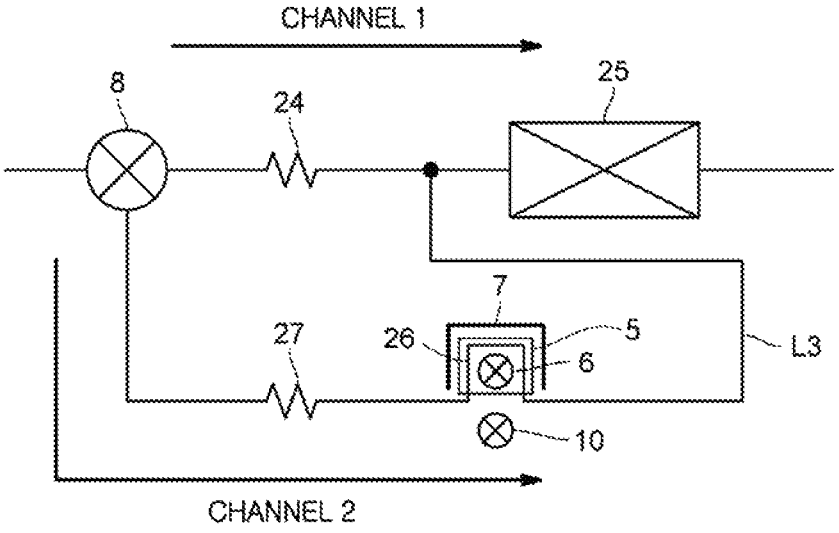
FIG. 9 is a view illustrating a cooling operation and an ice making operation of a cooling device according to another exemplary embodiment of the present disclosure.

A cooling operation and an ice making operation of the cooling device will be described with reference to FIG. 9. FIG. 9 is a view illustrating a cooling operation and an ice making operation of a cooling device according to another exemplary embodiment of the present disclosure.

In the case of cooling the cooling chamber, the control device allow the port adjacent to the condenser and the port adjacent to the main pressure reducing means in the switching valve 8 to be in communication with each other, thereby allowing the refrigerant to flow to the main pressure reducing means ('Channel 1' of FIG. 9). This Channel 1 is a channel arriving at the cooling evaporator 25 via the main pressure reducing means 24 rather than via the ice-making pressure reducing means 27 and the ice-making evaporator 26 at a downstream side of the condenser 22. Meanwhile, in the case of making ice, the control device allows the port adjacent to the condenser and the port adjacent to the bypass in the switching valve 8 to be in communication with each other, thereby allowing the refrigerant to flow to the bypass ('Channel 2' of FIG. 9). This Channel 2 is configured to arrive at the cooling evaporator 25 via the ice-making pressure reducing means 27 and the ice-making evaporator 26 at the downstream side of the condenser 22. In addition, the supply of the refrigerant to Channel 1 and the supply of the refrigerant to Channel 2 are alternately switched by the switching valve 8 to perform the cooling of the cooling chamber and the ice-making. In addition, the refrigerant evaporated in the cooling evaporator 25 does not need to flow to the ice-making evaporator 26, through the control as described above. For example, the control device may control switching of the channel and a time in which the refrigerant flows so that a temperature of the cooling chamber is maintained in any temperature region, while controlling a flow rate of refrigerant so that the refrigerant is in an overheat state at an outlet of the ice-making evaporator 26, in the case of allowing the refrigerant to flow to Channel 2.

Here, the switching of the switching valve 8 by the control device is performed in a time division scheme, and a period of the corresponding time division control is 2 to 180 seconds.

In addition, the control device senses completion of the ice-making by a detection temperature of the ice-making tray temperature sensor 6, and closes the port adjacent to the bypass after sensing the completion to allow the refrigerant not to flow to Channel 2 and start to conduct electricity to the deicing heater 7. Therefore, deicing from the ice-making tray 5 is performed. In addition, in this state, the control device allows the port adjacent to the condenser and the port adjacent to the bypass in the switching valve 8 to be in communication with each other, thereby allowing the refrigerant to flow to the cooling evaporator 25.

Here, before the electricity starts to be conducted to the deicing heater 7, that is, after the completion is sensed, the supply of the refrigerant to the ice-making evaporator 26 may be blocked to operate the compressor for a predetermined time. In addition, after the compressor is operated for the predetermined time, electricity may start to be conducted to the deicing heater 7.

Next, detail control contents at the time of the ice-making operation will be described with reference to the drawings.

Figure 10:
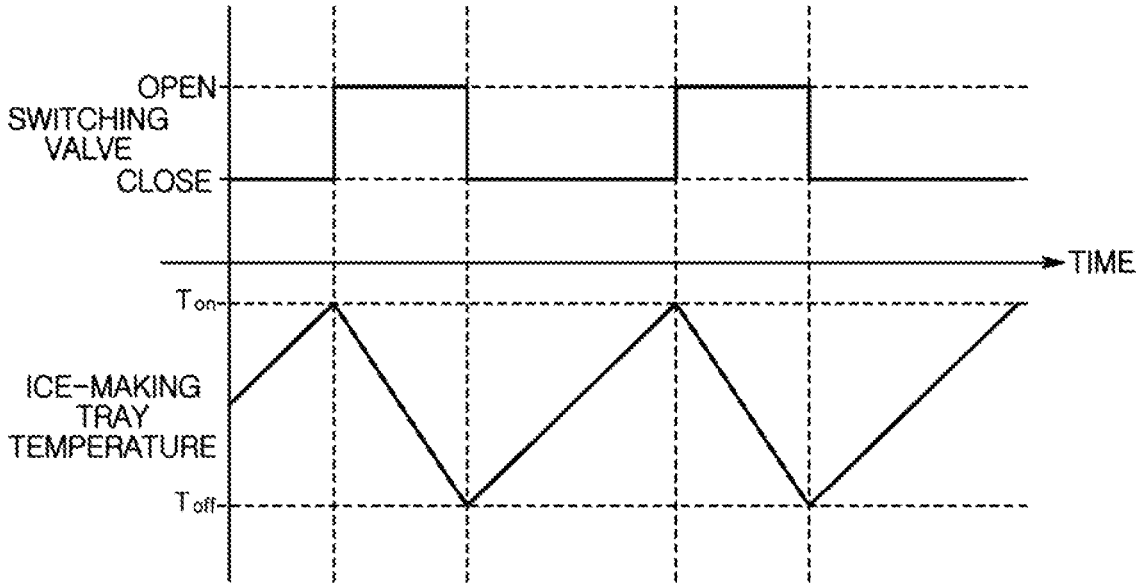
FIG. 10 is a view illustrating control content 1 at the time of ice-making of a cooling device according to another exemplary embodiment of the present disclosure.
Figure 11:
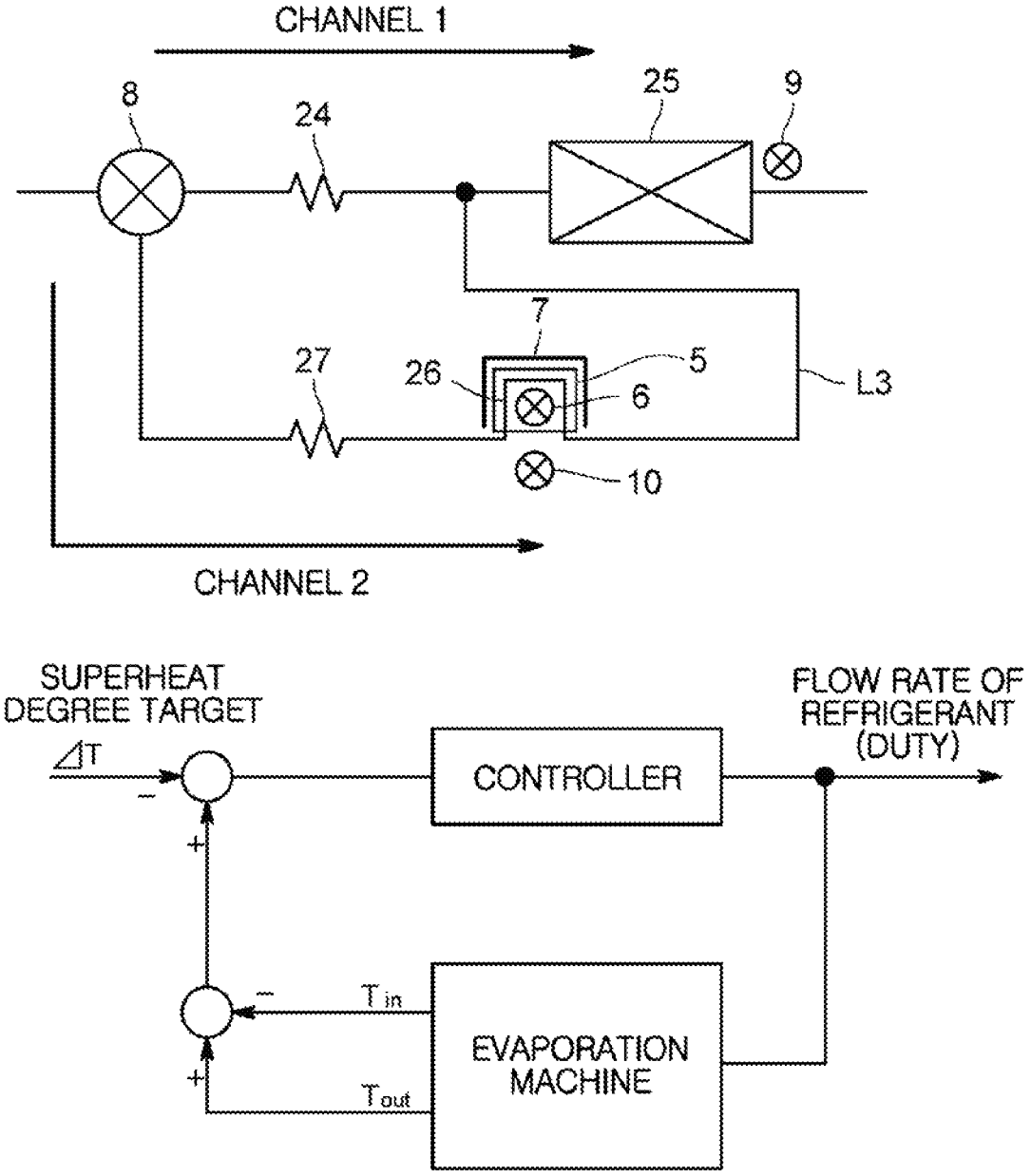
FIG. 11 is a view illustrating control content 2 at the time of ice-making of a cooling device according to another exemplary embodiment of the present disclosure.
Figure 12:
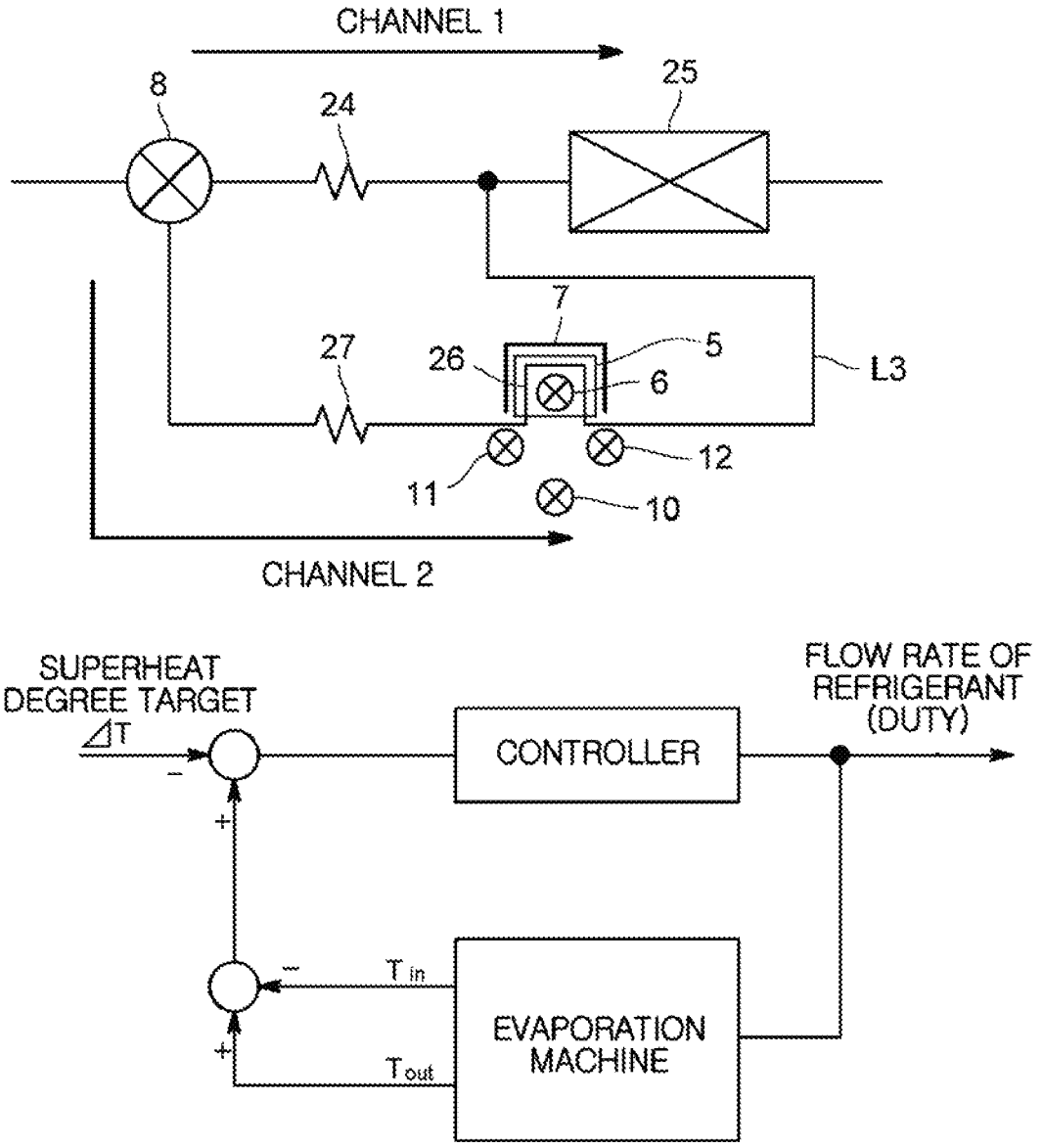
FIG. 12 is a view illustrating control content 3 at the time of ice-making of a cooling device according to another exemplary embodiment of the present disclosure.

FIGS. 10 to 12 are views illustrating control contents 1 to 3 at the time of ice-making of a cooling device according to another exemplary embodiment of the present disclosure.

(1) Control Content 1

As illustrated in FIG. 10, the control device controls a switch on/off the switching valve 8 on the basis of the detection temperature of the ice-making tray temperature sensor 6 to supply the refrigerant to the ice-making evaporator 26 or block the supply of the refrigerant to the ice-making evaporator 26. In detail, the detection temperature of the ice-making tray temperature sensor 6 is used as a representative value of a temperature of the ice-making evaporator 26, and the port adjacent to the condenser and the port adjacent to the bypass in the switching valve 6 are in communication with each other (the switching valve is 'open' in FIG. 10) when an ice-making tray temperature is $T_{on}$ or more and the port adjacent to the condenser and the port adjacent to the bypass in the switching valve 8 (the switching valve is 'close' in FIG. 10) are blocked when the ice-making tray temperature is $T_{off}$ or less. In addition, $T_{on}$ is set to a temperature lower than a temperature at which ice is not made since a temperature in the ice-making chamber is high. Further, $T_{off}$ is set to a temperature higher than a temperature at which heat exchange is not sufficiently conducted in the ice-making evaporator 26 and the refrigerant at an outlet of the ice-making evaporator 26 is not in an overheat state. Through the control as described above, the refrigerant alternately flows to Channel 1 and Channel 2, and the temperature in the ice-making chamber alternately traverses between a lower limit temperature $T_{off}$ and an upper limit temperature $T_{on}$. That is, the temperature in the ice-making chamber may be certainly maintained between the upper limit temperature and the lower limit temperature, and the outlet of the ice-making evaporator 26 may be maintained in an overheat state.

(2) Control Content 2

As illustrated in FIG. 11, the control device uses the detection temperature of the ice-making tray temperature sensor 6 as a representative value of a temperature of the ice-making evaporator 26, and measures a temperature difference between the detection temperature of the ice-making tray temperature sensor 6 and a detection temperature of an evaporator temperature sensor (a defrosting temperature sensor) 9 provided in the cooling evaporator 25. In addition, the evaporator temperature sensor 9 measures a temperature of the refrigerant at an outlet of the cooling evaporator 25.

In addition, the control device feedback-controls (time-division-controls) a duty of the switching valve so that the temperature difference (a superheat degree $\Delta T=T_{in}-T_{out}$) between the detection temperature $T_{in}$ of the ice-making tray temperature sensor 6 and the detection temperature $T_{out}$ of the evaporator temperature sensor 9 becomes constant. Therefore, the control device constantly maintains the superheat degree in the ice-making evaporator 26. In addition, a period of a first control cycle is set to, for example, 2 to 180 seconds, and the rest of a time in which the refrigerant flows to Channel 2 in the first control cycle becomes a time in which the refrigerant flows to Channel 1.

For example, in the case in which the control device proportionally controls the duty of the switching valve, an amount (duty) D(n) of refrigerant supplied to the ice-making evaporator 26 in an n-th cycle is calculated by Equation 1. In addition, kp is a proportional control gain.

$$D(n)=kp\{T_{out}(k-1)-T_{in}(k-1)-\Delta T\} \quad \text{(Equation 1)}$$

(3) Control Content 3

As illustrated in FIG. 12, the control device acquires detection temperatures of an inlet temperature sensor 11 and an outlet temperature sensor 12 provided, respectively, at an inlet and an outlet of the ice-making evaporator 26.

In addition, the control device feedback-controls (time-division-controls) a duty of the switching valve so that a temperature difference (a superheat degree $\Delta T=T_{in}-T_{out2}$) between the detection temperature $T_{in}$ of the inlet temperature sensor 11 and the detection temperature $T_{out2}$ of the outlet temperature sensor 12 becomes constant. In addition, a period of a first control cycle is set to, for example, 2 to 180 seconds, and the rest of a time in which the refrigerant flows to Channel 2 in the first control cycle becomes a time in which the refrigerant flows to Channel 1.

For example, in the case in which the control device proportionally controls the duty of the switching valve, an amount (duty) D(n) of refrigerant supplied to the ice-making evaporator 26 in an n-th cycle is calculated by Equation 2.

$$D(n)=kp\{T_{out2}(k-1)-T_{in}(k-1)-\Delta T\} \quad \text{(Equation 2)}$$

According to the cooling device 100 configured as described above, the ice-making evaporator 26 and the ice-making pressure reducing means 27 are provided in the third bypass L3, and the supply of the refrigerant to the ice-making evaporator 26 and the ice-making pressure reducing means 27 is switched by the third switching mechanism 8, thereby making it possible to continuously supply the refrigerant to the cooling evaporator 25 during deicing from the ice-making tray 5 and suppress a rise in the temperature of the cooling chamber.

In addition, in the case in which the refrigerant flows to Channel 2, the refrigerant at the outlet of the ice-making evaporator 26 is configured to be in the overheat state, such that a liquid refrigerant does not exist in the cooling evaporator 25 and only a gas refrigerant exists in the cooling evaporator 25. Therefore, as compared with the related art, a ratio of the liquid refrigerant in a refrigerant pipe of the entire refrigerator may be reduced and a ratio of the gas refrigerant in the refrigerant pipe of the entire refrigerator may be increased, such that a minimum amount of refrigerant filled in the refrigerator may be reduced. Therefore, even in the case of using a refrigerant having combustibility, safety in the use may be further improved.

In addition, in the case in which the refrigerant flows to Channel 2, even though the liquid refrigerant is not entirely evaporated in the ice-making evaporator 26 due to any cause, it may be evaporated in the cooling evaporator 25. Therefore, even though an accumulator, or the like, is not provided, a fault caused when the liquid refrigerant is sucked in the compressor 21 may be prevented.

Further, the present disclosure is not limited to another exemplary embodiment described above, but may also be configured as in modified examples of another exemplary embodiment of the present disclosure to be described below.

FIGS. 13 to 16 are views illustrating, respectively, configurations of freezing cycles of cooling devices according to modified examples of another exemplary embodiment of the present disclosure.

Figure 13:
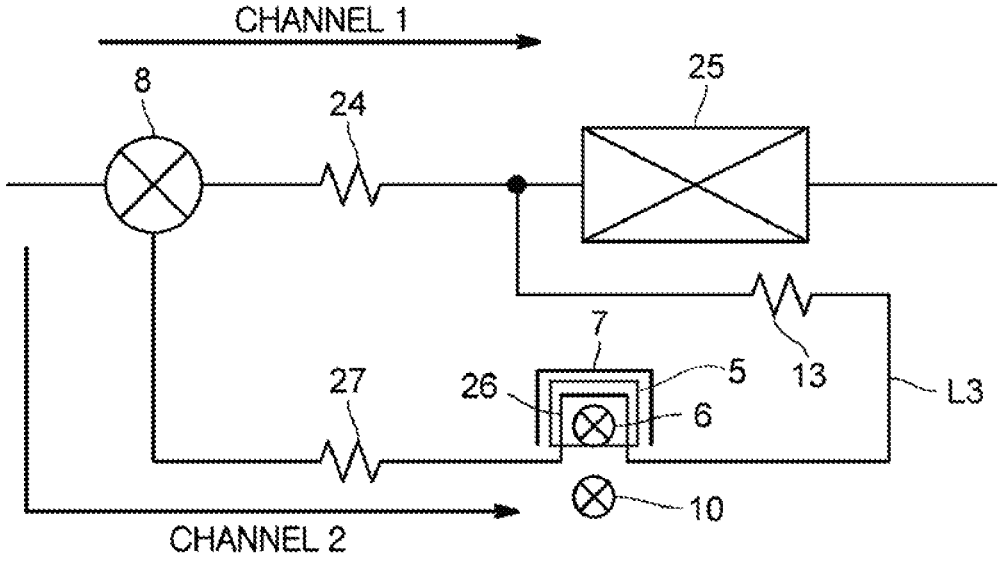
FIGS. 13 to 16 are views illustrating, respectively, configurations of freezing cycles according to modified examples of another exemplary embodiment of the present disclosure.

For example, as illustrated in FIG. 13, a second pressure reducing means 13 may be provided at a downstream side of the ice-making evaporator 26 in the third bypass L3.

Figure 14:
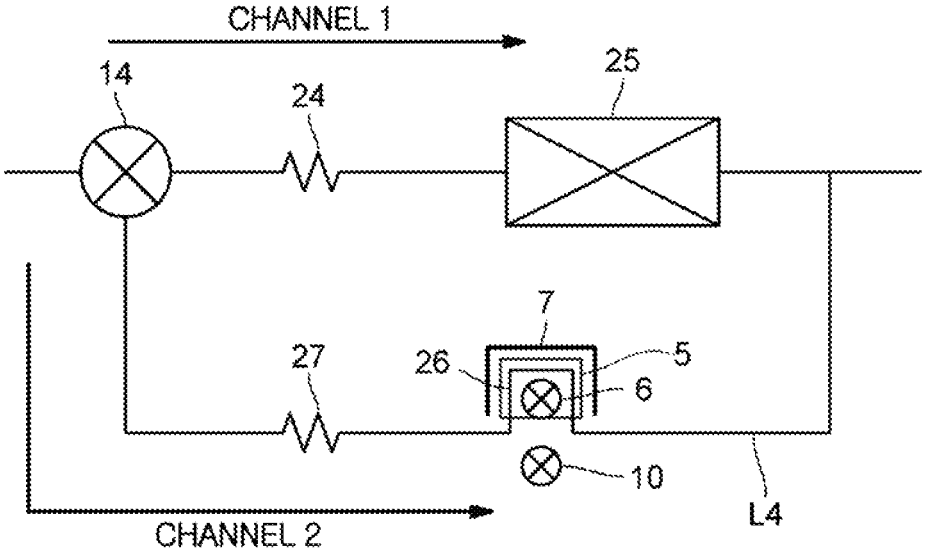

As a modified example of the cooling device, as illustrated in FIG. 14, the ice-making evaporator 26 and the ice-making pressure reducing means 27 may be provided in a fourth bypass L4 branched between the second condenser 22B and the main pressure reducing means 24 and joined between the cooling evaporator 25 and the compressor 21. In this case, a fourth switching mechanism 14 switching a channel is disposed at a branch point of the fourth bypass L4. The fourth switching mechanism 14 is a switching valve formed of a three-way valve. The switching valve 14 has a port adjacent to the condenser, a port adjacent to the bypass, and a port adjacent to the main pressure reducing means, and opening or closing of the switching valve 14 is controlled by a control device (not illustrated). In addition, a control content of the switching valve 14 is the same as that of another exemplary embodiment of the present disclosure described above.

Figure 15:
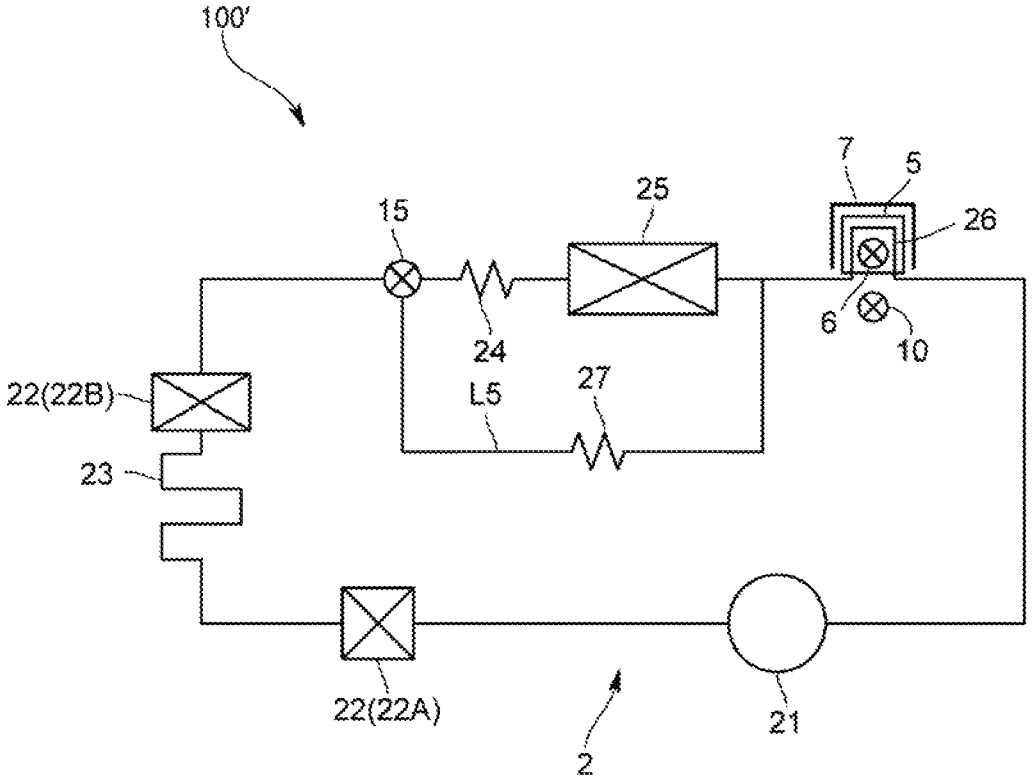

In addition, as illustrated in FIG. 15, the ice-making pressure reducing means 27 may be provided in a fifth bypass L5 branched between the second condenser 22B and the main pressure reducing means 24 and joined between the cooling evaporator 25 and the compressor 21, and the ice-making evaporator 26 may be provided between a joining point of the fifth bypass L5 and the compressor 21. In this case, a fifth switching mechanism 15 switching a channel is disposed at a branch point of the fifth bypass L5. The fifth switching mechanism 15 is a switching valve formed of a three-way valve. The switching valve 15 has a port adjacent to the condenser, a port adjacent to the bypass, and a port adjacent to the main pressure reducing means, and opening or closing of the switching valve 15 is controlled by a control device (not illustrated). Due to this configuration, an amount of refrigerant in the freezing cycle may be reduced.

Figure 16:
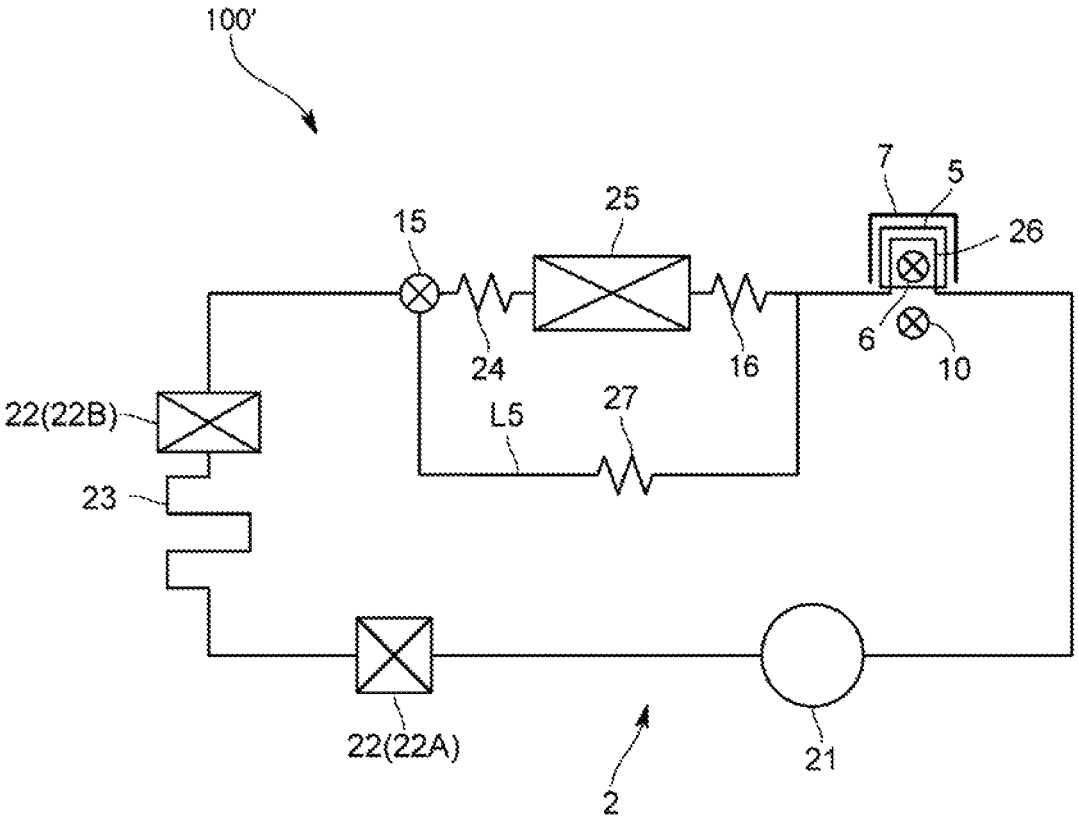

In addition, as illustrated in FIG. 16, a third pressure reducing means 16 may be provided between the joining point of the fifth bypass L5 and the cooling evaporator 24.

The present disclosure is not limited to the exemplary embodiments described above, but may be variously modified without departing from the spirit of the present disclosure.

The invention claimed is:

1. A refrigerator comprising:

a freezing cycle including:

a compressor;

a first condenser and a second condenser independent from each other and connected to each other through a dew condensation preventing pipe, the second condenser being positioned at a downstream side of the first condenser in a refrigerant channel;

a cooling evaporator;

a first pressure reducing tube disposed along the refrigerant channel and connected to the cooling evaporator;

a bypass branched between the second condenser and the first pressure reducing tube and joined between the first pressure reducing tube and the cooling evaporator, an ice-making evaporator disposed in the bypass;

an ice-making tray;

a second pressure reducing tube disposed at an upstream side of the ice-making evaporator in the bypass;

a temperature sensor provided in the ice-making tray; and a switching valve disposed at a branch point of the bypass, the switching valve being configured to switch a flow of refrigerant along the refrigerant channel to maintain a temperature detected by the temperature sensor between an upper limit temperature and a lower limit temperature by:

connecting the second condenser and the bypass when the temperature detected by the temperature sensor is greater than or equal to the upper limit temperature value during which the ice-making evaporator is not to be operated, and connecting the second condenser and the first pressure reducing tube when the temperature detected by the temperature sensor is less than or equal to the lower limit temperature value during which the ice-making evaporator is to be operated.

2. The refrigerator as claimed in claim 1, further comprising:

a third pressure reducing tube disposed at a downstream side of the ice-making evaporator in the bypass.

* * * * *